US011141624B2

(12) United States Patent
Wu

(10) Patent No.: US 11,141,624 B2
(45) Date of Patent: Oct. 12, 2021

(54) HYBRID RESISTANCE ADJUSTMENT SYSTEM

(71) Applicant: Mu-Chuan Wu, Tainan (TW)

(72) Inventor: Mu-Chuan Wu, Tainan (TW)

( * ) Notice: Subject to any disclaimer, the term of this patent is extended or adjusted under 35 U.S.C. 154(b) by 3 days.

(21) Appl. No.: 16/575,450

(22) Filed: Sep. 19, 2019

(65) Prior Publication Data

US 2020/0121981 A1 Apr. 23, 2020

(30) Foreign Application Priority Data

Oct. 22, 2018 (TW) ..... 107137131

(51) Int. Cl.
*A63B 22/06* (2006.01)
*A63B 21/00* (2006.01)
(Continued)

(52) U.S. Cl.
CPC ..... *A63B 22/0605* (2013.01); *A63B 21/0051* (2013.01); *A63B 21/00069* (2013.01);
(Continued)

(58) Field of Classification Search
CPC ..... A63B 21/0056; A63B 21/00069; A63B 21/00076; A63B 21/015; A63B 21/225; A63B 22/0605; A63B 2220/54
See application file for complete search history.

(56) References Cited

U.S. PATENT DOCUMENTS 7,018,324 B1 3/2006 Lin
8,052,581 B1 * 11/2011 Lohr ..... A63B 21/015 482/63
(Continued)

FOREIGN PATENT DOCUMENTS

CN 2680304 Y 2/2005
CN 108114410 A 12/2017
(Continued)

OTHER PUBLICATIONS

Office Action dated Oct. 10, 2020, issued in corresponding Chinese application No. 201910630319.5.
(Continued)

*Primary Examiner* — Nyca T Nguyen
*Assistant Examiner* — Andrew M Kobylarz
(74) *Attorney, Agent, or Firm* — Bacon & Thomas, PLLC

(57) ABSTRACT

A hybrid resistance adjustment system is used on an exercise bike which has a frame and a flywheel, and the hybrid resistance adjustment system has a resistance assembly, a manual adjustment assembly, and an electronic adjustment assembly. The resistance assembly is mounted on the frame and has a mounting seat pivotally connected to the frame, a brake pad and a magnetic set. The mounting seat is pivotally connected to the frame. The brake pad and the magnetic set are mounted on the mounting seat. The manual adjustment assembly is mounted on the frame and has a shaft. The electronic adjustment assembly is mounted on the frame and has a linearly movable component and a motor. The motor is connected to the linearly movable component. The shaft and the linearly movable component selectively push the mounting seat to simultaneously make the brake pad abut against the flywheel.

3 Claims, 6 Drawing Sheets

(51) Int. Cl.

| | |
|---|---|
| ***A63B 21/005*** | (2006.01) |
| ***A63B 21/015*** | (2006.01) |
| ***A63B 21/22*** | (2006.01) |
| ***A63B 24/00*** | (2006.01) |
| ***A63B 23/04*** | (2006.01) |

(52) U.S. Cl.
CPC ..... *A63B 21/015* (2013.01); *A63B 21/225* (2013.01); *A63B 24/0087* (2013.01); *A63B 23/0476* (2013.01)

(56) References Cited

U.S. PATENT DOCUMENTS

| | | | | |
|---|---|---|---|---|
| 9,707,430 | B2 * | 7/2017 | Wu | A63B 21/00069 |
| 2011/0251020 | A1 | 10/2011 | Caragio | |
| 2019/0262651 | A1 * | 8/2019 | Huang | A63B 21/00069 |

FOREIGN PATENT DOCUMENTS

| | | | |
|---|---|---|---|
| CN | 206700600 | U | 12/2017 |
| CN | 206715143 | U | 12/2017 |
| CN | 207898850 | U | 9/2018 |
| DE | 202018101703 | U1 | 4/2018 |
| TW | I252119 | | 4/2006 |
| TW | M552360 | U | 12/2017 |
| TW | M565048 | U | 8/2018 |
| WO | 2020/028883 | A1 | 2/2020 |

OTHER PUBLICATIONS

Office Action dated Jun. 10, 2021, issued in corresponding Chinese application No. 201910630319.5.

* cited by examiner

HYBRID RESISTANCE ADJUSTMENT SYSTEM

BACKGROUND OF THE INVENTION

1. Field of the Invention

The present invention relates to a hybrid resistance adjustment system, and more particularly to a hybrid resistance adjustment system that is used on an exercise equipment such as an exercise bike.

2. Description of Related Art

Generally, exercise equipment such as an exercise bike may provide a resistance adjustment system for adjusting resistance according to users' physical conditions and sports demands. Thereby, the user can adjust resistance of the exercise equipment to achieve the best fitness and training effect.

A conventional resistance adjustment system has a resistance assembly and an adjustment assembly. The resistance assembly is mounted on a frame of an exercise bike and has a mounting seat, multiple magnetic sets, and a brake pad. The mounting seat is pivotally connected to the frame. The multiple magnetic sets and the brake pad are mounted on the mounting seat. The adjustment assembly is mounted on the frame and connected with the resistance assembly to adjust the resistance assembly by swinging.

The adjustment assembly is capable of driving the resistance assembly to swing toward a flywheel of the exercise bike when the user wants to increase the resistance. Thereby, the multiple magnetic sets become closer to the flywheel and the force that the brake pad applies on the flywheel is increased, so as to increase the resistance. The adjustment assembly is capable of driving the resistance assembly to swing away from the flywheel when the user wants to reduce the resistance. Thereby, the multiple magnetic sets move away from the flywheel and the force that the brake pad applies on the flywheel is reduced, so as to reduce the resistance.

The conventional resistance adjustment system can be further divided into an electronically-controlled type and a manually-controlled type according to the types of the adjustment assembly. In the electronically-controlled type resistance adjustment system, the adjustment assembly drives the resistance assembly through a driving motor, thereby adjusting the resistance or timely stopping rotation of the flywheel. In the manually-controlled type resistance adjustment system, the adjustment assembly connects with the resistance assembly through a shaft moving linearly, thereby allowing the user to adjust the resistance by rotating or pressing the shaft to timely stop the rotation of the flywheel.

However, regardless that the resistance adjustment system is the electronically-controlled type or the manually-controlled type, the resistance assembly is controlled by a single adjustment assembly. Although the electronically-controlled type resistance adjustment system allows the user to accurately control the resistance, there may be problems in timely stopping the flywheel. Although the manually-controlled type resistance adjustment system is more insufficient for accurately controlling the resistance than the electronically-controlled type resistance adjustment system, when the user wants to stop the flywheel urgently, the flywheel can be directly stopped by pressing the shaft.

To overcome the shortcomings, the present invention provides a hybrid resistance adjustment system to obviate the aforementioned problems.

SUMMARY OF THE INVENTION

The main objective of the invention is to provide a hybrid resistance adjustment system that solves the problem that a resistance assembly of a conventional resistance adjustment system controlled by a single adjustment assembly, so that it is difficult to accurately control the resistance and stop the flywheel timely.

The hybrid resistance adjustment system is used on an exercise bike which has a frame and a flywheel mounted on the frame. The hybrid resistance adjustment system comprises a resistance assembly, a manual adjustment assembly, and an electronic adjustment assembly. The resistance assembly is mounted on the frame and has a mounting seat, a brake pad, at least one magnetic set, and a restoring spring. The mounting seat is pivotally connected to the frame. The brake pad is mounted on the mounting seat. The at least one magnetic set is mounted on the mounting seat and each of the at least one magnetic set has two magnetic elements respectively located on opposite sides of the flywheel. The restoring spring is mounted on the frame and connected to the mounting seat, and the restoring spring is capable of driving the mounting seat to return to an original position.

The manual adjustment assembly is mounted on the frame and has a shaft being linearly movable relative to the frame. The shaft selectively pushes the mounting seat of the resistance assembly to simultaneously make the brake pad abut against the flywheel and make the at least one magnetic set to approach the flywheel.

The electronic adjustment assembly is mounted on the frame and has a linearly movable component and a motor. The linearly movable component moves linearly relative to the frame. The motor is connected to the linearly movable component and selectively drives the linearly movable component to move linearly and push the mounting seat of the resistance assembly to simultaneously snake the brake pad abut against the flywheel and make the at least one magnetic set approach the flywheel.

The hybrid resistance adjustment system in accordance with the present invention provides a user with resistance control when using an exercise equipment such as the exercise bike. When the user tends to increase the resistance, by operating the electronic adjustment assembly, the user is able to drive the linearly movable component to push the resistance assembly. The linearly movable component pushes the mounting seat to increase the strength that the brake pad of the resistance assembly abuts against the flywheel and the resistance that the two magnetic elements apply on the flywheel. When the user needs to stop rotation of the flywheel due to emergency, by directly pressing the shaft to push the resistance assembly, the brake pad of the resistance assembly presses upon the flywheel to provide a maximum resistance to the flywheel. The flywheel can stop rotating immediately.

Therefore, the hybrid resistance adjustment system in accordance with the present invention has the following advantages.

1. Increase the resistance adjustment accuracy: the electronic adjustment assembly controls the linearly movable component to push the resistance assembly, such that the mounting seat approaches the flywheel for the brake pad to abut against the flywheel to increase the resistance. Through the electronic adjustment assembly, the accuracy of the resistance adjustment is improved.

2. Improve the function of stopping the flywheel immediately; when the user tends to timely stop the rotation of the flywheel, by directly pressing the shaft to abut against the resistance assembly, the brake pad presses upon the flywheel to timely stop the flywheel from rotating. By operating the manual adjustment assembly, the user can control the strength of pressing the brake pad. Moreover, with the magnetic effect of the two magnetic elements, the rotation speed of the flywheel can be slowed down, so that the flywheel can stop rotating.

Other objects, advantages and novel features of the invention will become more apparent from the following detailed description when taken in conjunction with the accompanying drawings.

DETAILED DESCRIPTION OF PREFERRED EMBODIMENT

With reference to FIGS. 1 to 4, a hybrid resistance adjustment system in accordance with the present invention is used on an exercise bike which has a frame 40 and a flywheel 41 mounted on the frame 40, and the hybrid resistance adjustment system comprise a resistance assembly 10A, 10B, a manual adjustment assembly 20, and an electronic adjustment assembly 30A, 30B.

Figure 1:
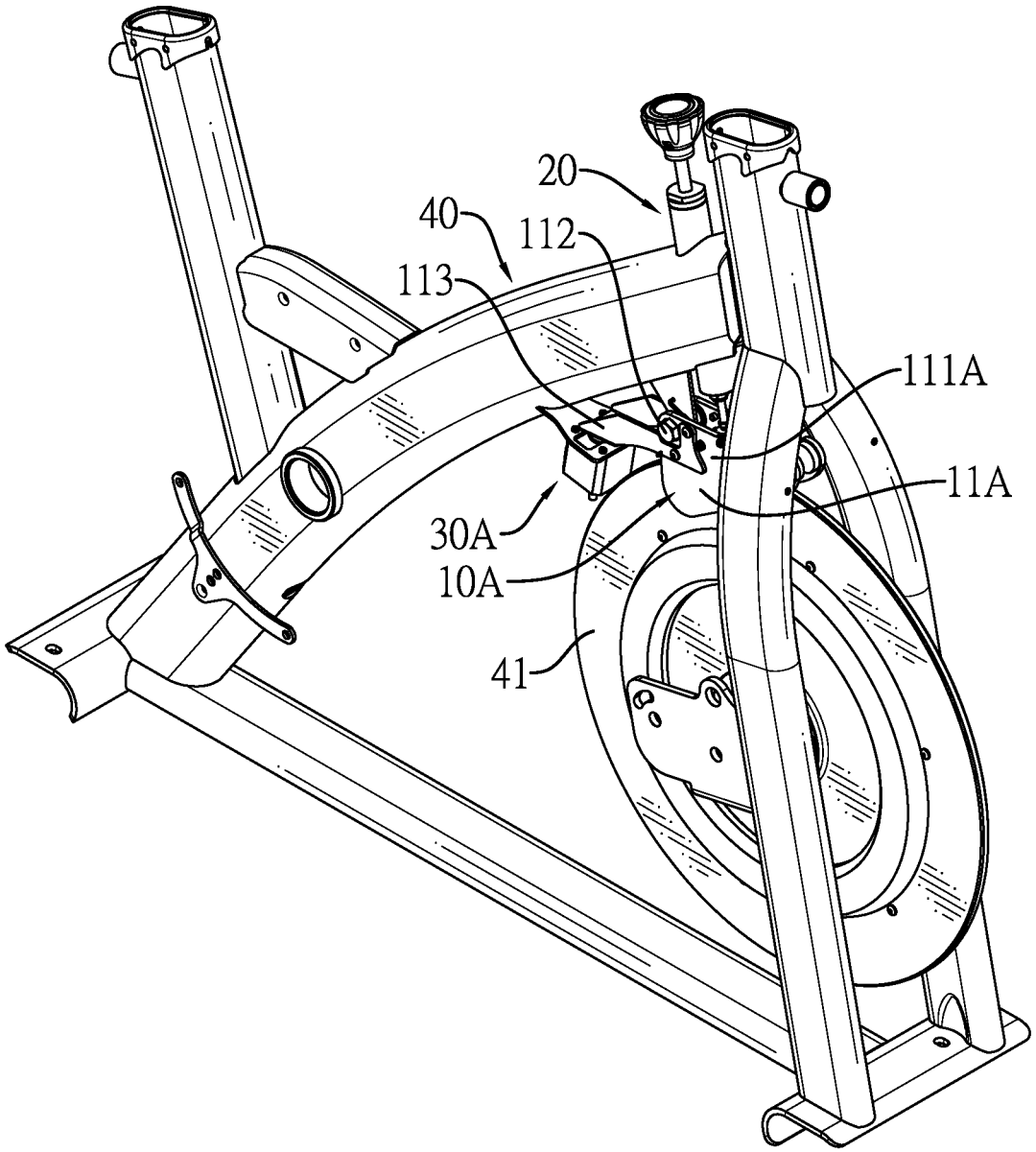
FIG. 1 is a perspective view of a first embodiment of a hybrid resistance adjustment system applied on an exercise bike.
Figure 2:
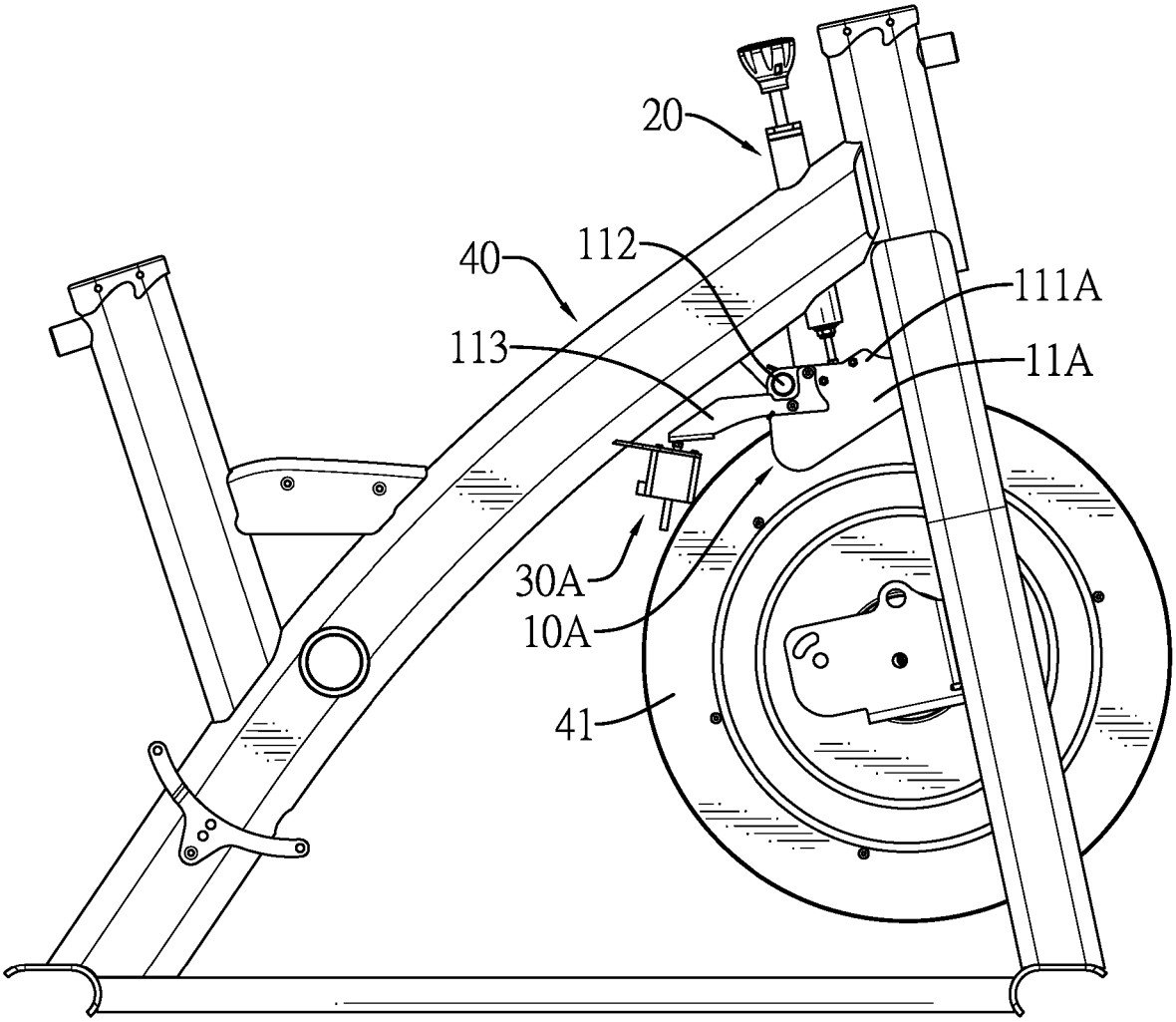
FIG. 2 is a side view of the hybrid resistance adjustment system in FIG. 1.
Figure 3:
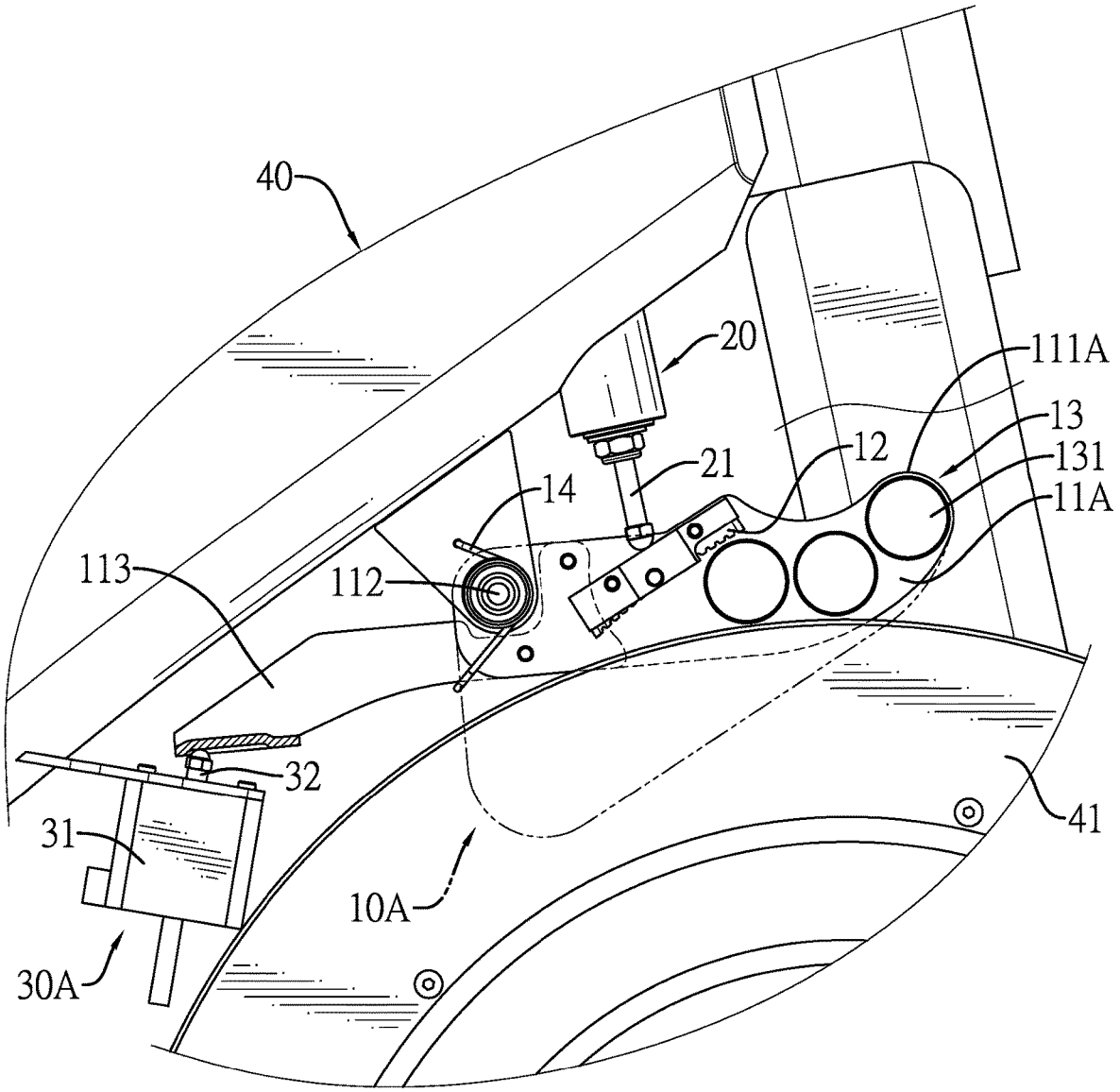
FIG. 3 is an enlarged side view of the hybrid resistance adjustment system in FIG. 1.
Figure 4:
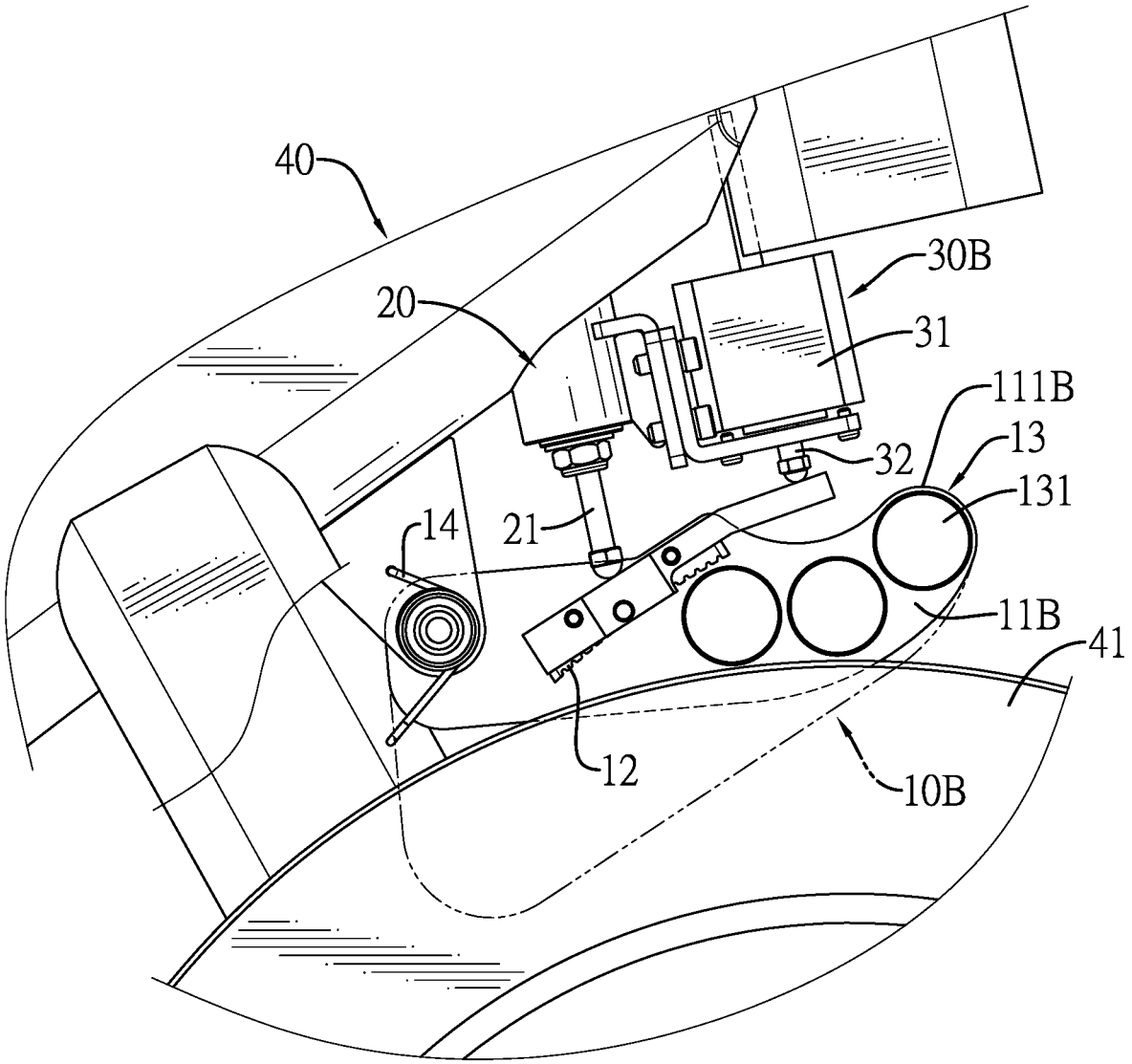
FIG. 4 is an enlarged side view of a second embodiment of a hybrid resistance adjustment system in accordance with the present invention.

With reference to FIGS. 3 and 4, the resistance assembly 10A, 10B is mounted on the frame 40 and has a mounting seat 11A, 11B, a brake pad 12, at least one magnetic set 13, and a restoring spring 14. The mounting seat 11A, 11B is pivotally connected to the frame 40. The brake pad 12 is mounted on the mounting seat 11A, 11B. The at least one magnetic set 13 is mounted on the mounting seat 11A, 11B and each of the at least one magnetic set 13 has two magnetic elements 131 respectively located on opposite sides of the flywheel 41. The restoring spring 14 is mounted on the frame 40 and connected to the mounting seat 11A, 11B, and is capable of driving the mounting seat 11A, 11B to return to an original position. Specifically, the restoring spring 14 is a torsion spring having two ends respectively connected to the frame 40 and the mounting seat 114, 11B.

With reference to FIGS. 3 and 4, the manual adjustment assembly 20 is mounted on the frame 40 and has a shaft 21 being linearly movable relative to the frame 40. The shaft 21 selectively pushes directly on the mounting seat 11A, 11B of the resistance assembly 10A, 10B directly to simultaneously make the brake pad 12 abut against the flywheel 41 and make the at least one magnetic set 13 approach the flywheel 41.

With reference to FIGS. 3 and 4, the electronic adjustment assembly 30A, 30B is mounted on the frame 40 and has a linearly movable component 32 and a motor 31. The linearly movable component 32 moves linearly relative to the frame 40. The motor 31 is connected to the linearly movable component 32 and selectively drives the linearly movable component 32 to move linearly and push directly on the mounting seat 11A, 11B of the resistance assembly 10A, 10B directly to simultaneously make the brake pad 12 abut against the flywheel 41 and make the at least one magnetic set 13 approach the flywheel 41.

With reference to FIG. 3, in a first preferred embodiment of the hybrid resistance adjustment system, the mounting seat 11A has a front side 111A, a pivot point 112, and a rear side 113. The front side 111A and the rear side 113 are oppositely defined on the mounting seat 11A. The pivot point 112 is defined between the front side 111A and the rear side 113 and is pivotally connected to the frame 40. The shaft 21 of the manual adjustment assembly 20 abuts against the front side 111A of the mounting seat 11A and the linearly movable component 32 of the electronic adjustment assembly 30A abuts against the rear side 113 of the mounting seat 11A. With reference to FIG. 4, in a second preferred embodiment of the hybrid resistance adjustment system, the shaft 21 of the manual adjustment assembly 20 and the linearly movable component 32 of the electronic adjustment assembly 30B abut against the front side 111B of the mounting seat 11B.

When the hybrid resistance adjustment system is in use, with reference to FIGS. 3 and 4, the resistance assembly 10A, 10B is controlled by the manual adjustment assembly 20 and the electronic adjustment assembly 30A, 30B to simultaneously make the brake pad 12 of the resistance assembly 10A, 10B contact the flywheel 41 and make the at least one magnetic set 13 approach the flywheel 41. Specifically, the user controls the electronic adjustment assembly 30A, 30B to adjust the strength that the brake pad 12 of the resistance assembly 10A, 10B abuts against the flywheel 41 and the resistance that the two magnetic elements 131 apply on the flywheel 41. In addition, the user controls the manual adjustment assembly 20 to simultaneously allow the brake pad 12 to abut against the flywheel 41 and the two magnetic elements 131 to be moved to the opposite sides of the flywheel 41 to stop the flywheel 41 timely.

Figure 6:
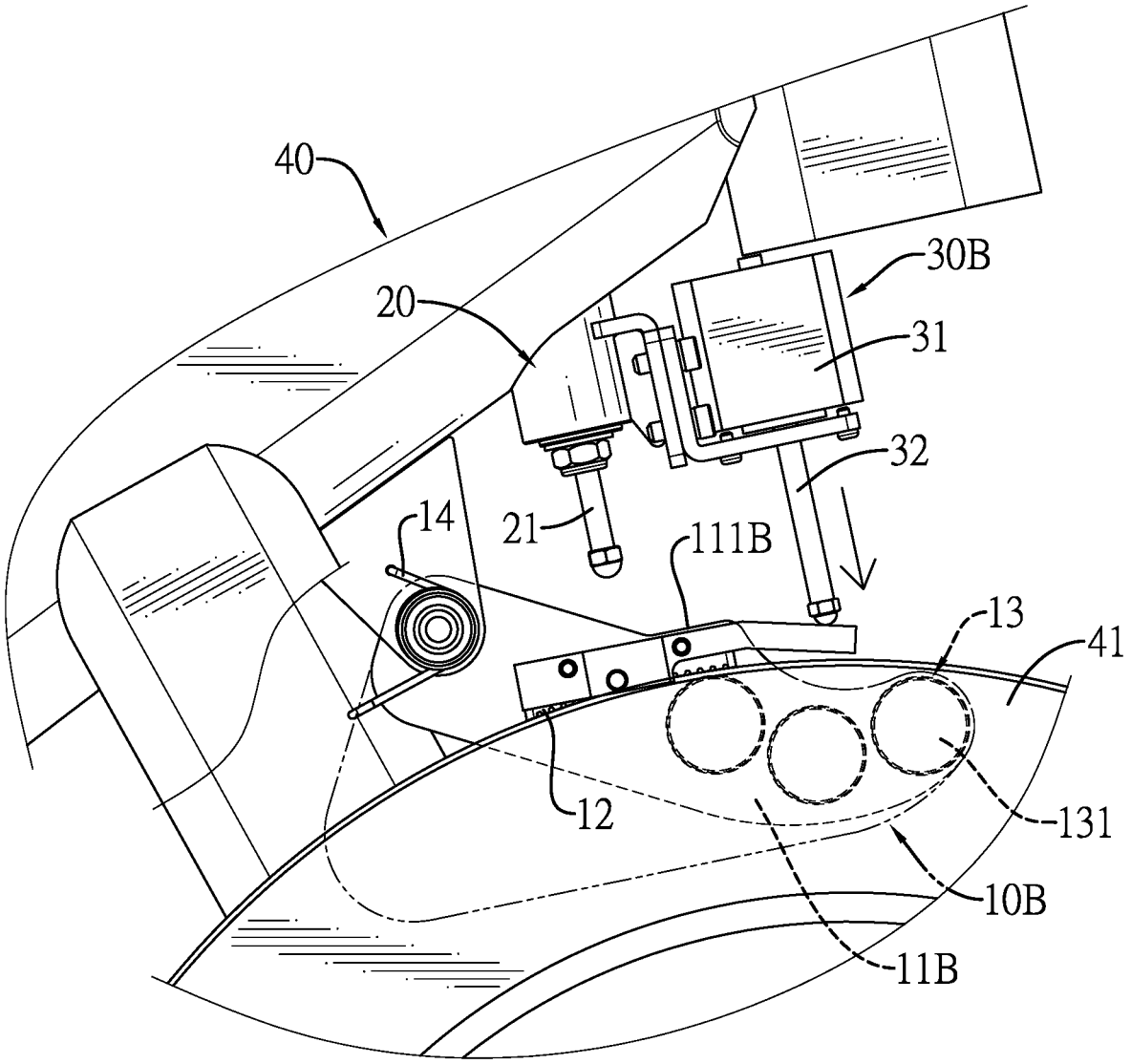
FIG. 6 is an enlarged side view of a second embodiment of a hybrid resistance adjustment system in FIG. 4, showing an electronic adjustment assembly pushing the resistance element to stop the flywheel.

With reference to FIG. 6, when the second preferred embodiment of the hybrid resistance adjustment system is in use and the user intends to increase the resistance, by operating the electronic adjustment assembly 30B, the user is able to drive the linearly movable component 32 to push the resistance assembly 10B. The linearly movable component 32 pushes the mounting seat 11B to increase the strength that the brake pad 12 of the resistance assembly 10B abuts against the flywheel 41 and to make the two magnetic elements 131 approach the flywheel 41 to increase the resistance applied on the fly wheel 41. Meanwhile, the restoring spring 14 is twisted and exerts a restoring force on the mounting seat 11B.

When the user intends to reduce the resistance, by operating the electronic adjustment assembly 30B, the user is able to drive the linearly movable component 32 to leave the resistance assembly 10B. As the linearly movable component 32 leaves the mounting seat 11B, the restoring force that the restoring spring 14 exerts on the mounting seat 11B pushes the mounting seat 11B to return to the original position. Accordingly, the strength that the mounting seat 11B applies on the brake pad 12 of the resistance assembly 10B is reduced and the two magnetic elements 131 leave the flywheel 41 to achieve the effect of resistance reduction.

Figure 5:
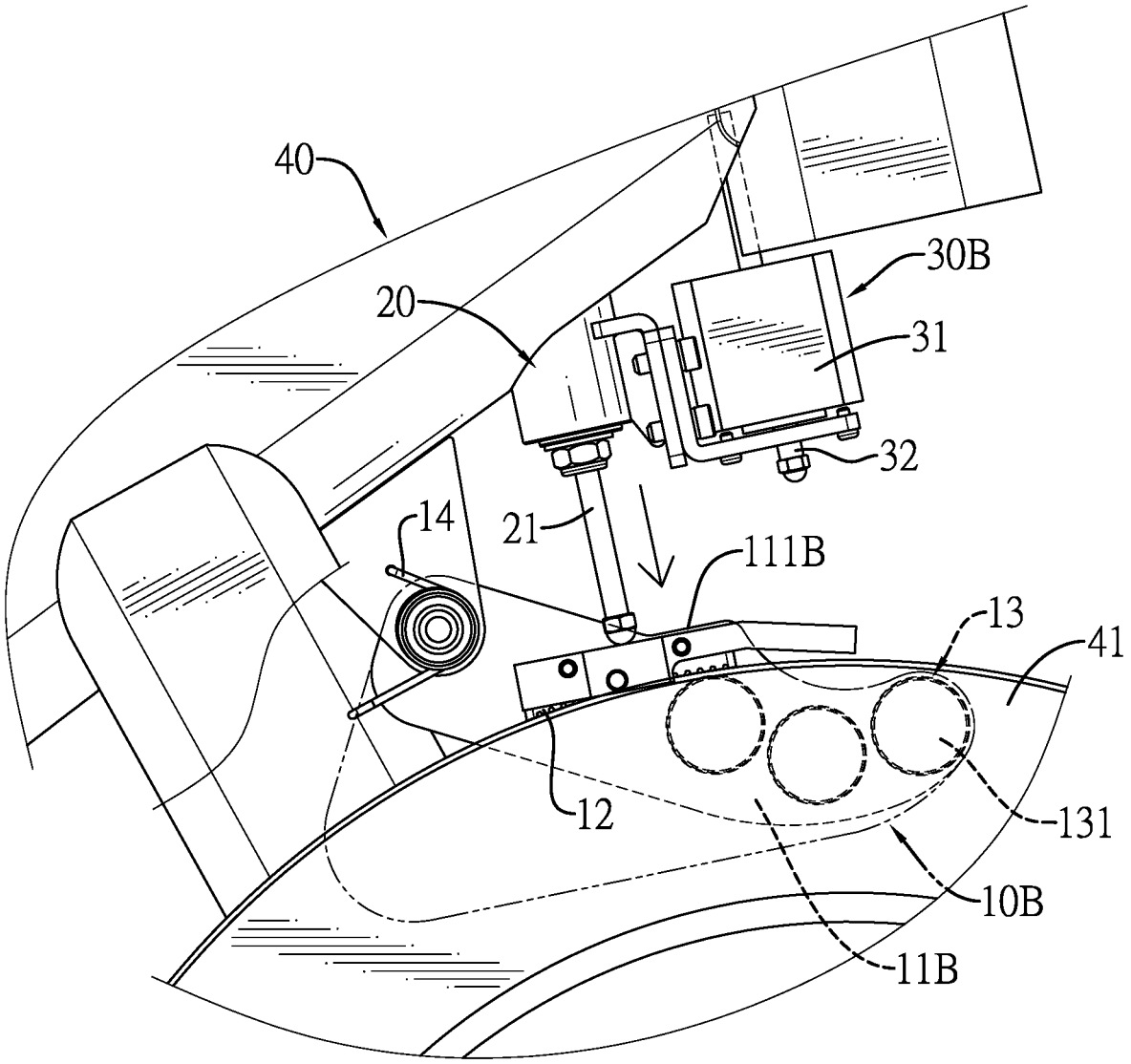
FIG. 5 is an enlarged side view of a second embodiment of a hybrid resistance adjustment system in FIG. 4, showing a manual adjustment assembly pushing the magnetic set to be disposed beside the flywheel.

With reference to FIG. 5, when the user needs to stop rotation of the flywheel 41 due to emergency, by directly pressing the shaft 21 of the manual adjustment assembly 20, the shaft 21 is capable of directly pushing the resistance assembly 10B, so that the brake pad 12 of the resistance assembly 10B presses upon the flywheel 41, and the two magnetic elements 131 of the at least one magnet set 13 are moved to the opposite sides of the flywheel 41. Accordingly, a maximum resistance to the flywheel 41 is provided, so that the flywheel 41 can stop rotating immediately.

The electronic adjustment assembly 30A, 30B allows the users to precisely control the resistance that is applied on the flywheel 41, and the manual adjustment assembly 20 is able to directly stop the rotation of the flywheel 41 when the shaft 21 is pressed.

Accordingly, in the hybrid resistance adjustment system of the present invention, with the electronic adjustment assembly 30A, 30B, the user is able to precisely control the resistance that is applied on the flywheel 41, and with the manual adjustment assembly 20, the user is able to stop the rotation of the flywheel 41 immediately. The hybrid resistance adjustment system is capable of simultaneously having high resistance adjustment accuracy and the function of stopping the flywheel 41 immediately.

What is claimed is:

1. A hybrid resistance adjustment system used on an exercise bike which has a frame and a flywheel mounted on the frame, the hybrid resistance adjustment system comprising:

a resistance assembly mounted on the frame and having
- a mounting seat pivotally connected to the frame;
- a brake pad mounted on the mounting seat;
- at least one magnetic set mounted on the mounting seat and each of the at least one magnetic set having two magnetic elements respectively located on opposite sides of the flywheel; and
- a restoring spring mounted on the frame and connected to the mounting seat, the restoring spring being capable of driving the mounting seat to return to an original position;

a manual adjustment assembly mounted on the frame and having
- a shaft being linearly movable to the frame and selectively pushing directly on the mounting seat of the resistance assembly to simultaneously make the brake pad abut against the flywheel and make the at least one magnetic set approach the flywheel; and an electronic adjustment assembly mounted on the frame and having
- a linearly movable component moving linearly relative to the frame; and
- a motor connected to the linearly movable component and selectively driving the linearly movable component to move linearly and push directly on the mounting seat of the resistance assembly to simultaneously make the brake pad abut against the flywheel and make the at least one magnetic set approach the flywheel.

2. The hybrid resistance adjustment system as claimed in claim 1, wherein the mounting seat has
- a front side;
- a pivot point formed at the mounting seat, which is pivotally connected to the frame; and
- a rear side, the rear side and the front side oppositely defined on the mounting seat, and the pivot point defined between the rear side and the front side, and the shaft abuts against the front side of the mounting seat and the linearly movable component abuts against the rear side of the mounting seat.

3. The hybrid resistance adjustment system as claimed in claim 1, wherein the mounting seat has a front side, and the shaft and the linearly movable component abut against the front side of the mounting seat.

* * * * *